US010543586B2

(12) United States Patent
Yang et al.

(10) Patent No.: US 10,543,586 B2
(45) **Date of Patent: *Jan. 28, 2020**

(54) RATCHET WRENCH AND METHOD FOR MAKING THE SAME

(71) Applicants: Chun-Wei Yang, Taichung (TW); Zhe-Ping Zhang, Taichung (TW)

(72) Inventors: Chun-Wei Yang, Taichung (TW); Zhe-Ping Zhang, Taichung (TW)

( * ) Notice: Subject to any disclaimer, the term of this patent is extended or adjusted under 35 U.S.C. 154(b) by 184 days.

This patent is subject to a terminal disclaimer.

(21) Appl. No.: 15/424,764

(22) Filed: Feb. 3, 2017

(65) Prior Publication Data

US 2017/0144276 A1 May 25, 2017

(51) Int. Cl.
*B25B 13/46* (2006.01)
*B25B 13/04* (2006.01)

(52) U.S. Cl.
CPC ..... *B25B 13/463* (2013.01); *B25B 13/04* (2013.01)

(58) Field of Classification Search
None
See application file for complete search history.

(56) References Cited

U.S. PATENT DOCUMENTS 6,282,993 B1 * 9/2001 Forman ..... B25B 13/463 81/63
6,907,804 B2 * 6/2005 Shu-Ying ..... B25B 13/463 81/63.1
2017/0036325 A1 * 2/2017 Liao ..... B25B 13/463

* cited by examiner

*Primary Examiner* — Brian D Keller

(57) ABSTRACT

A ratchet wrench includes a body, a ratchet wheel, a pawl, a ring, a top clip and a bottom clip. The body includes a through hole which defines through the top and the bottom of the body. A top recessed area and a bottom recessed area are respectively defined in the top and the bottom of the body. A recess is defined in the inner periphery of the through hole and a protrusion with a receiving slot extends from one end of the recess. A resilient member is received in the receiving slot to bias the pawl in the recess to engage with the ratchet wheel. The ring is engaged with the top recessed area. The top clip is engaged with the top recessed area and clips the ratchet wheel. The bottom clip is engaged with the bottom recessed area and clips the ratchet wheel.

10 Claims, 9 Drawing Sheets

RATCHET WRENCH AND METHOD FOR MAKING THE SAME

BACKGROUND OF THE INVENTION

1. Fields of the Invention

The present invention relates to a ratchet wrench, and more particularly, to a ratchet wrench which is manufactured at low cost and has sufficient strength.

2. Descriptions of Related Art

The conventional ratchet wrench known to applicant is disclosed in FIGS. 17 to 19, and comprises a body 91 having a through hole 911, and a recess 912 is defined in the inner periphery of the through hole 911. The recess 912 includes a closed top and a closed bottom. A receiving slot 914 is defined in the inner periphery of the recess 912. A lip 915 extends inward from the bottom of the head 91. A ratchet wheel 92 is rotatably received in the through hole 911 and rested on the lip 915. The ratchet wheel 92 includes a ratchet portion 921 and a connection hole 922. A pawl 93 includes a toothed portion 931 and is received in the recess 912. A resilient member 94 is received in the receiving slot 914 and biases the pawl 93 to engage the toothed portion 931 with the ratchet portion 921. A clip 96 is engaged within the receiving slot 914 and a groove 923 of the ratchet wheel 92 to pivotably position the ratchet wheel 92 in the through hole 911.

However, as shown in FIGS. 18 and 19, the volume of the pawl 93 is 1/16 of the volume of the recess 912, therefore, a space 95 is formed beside the pawl 93. When operating the ratchet wrench and the ratchet wheel 92 is applied by a significant resistance, and the ratchet wrench is rotated counter clockwise, the ratchet wheel 92 directly drives the pawl 93 to move in the recess 912. The larger than space 95 is, the larger the angle that the ratchet wrench is freely rotated. In other words, the pawl 93 is not disengaged from the ratchet wheel 92. In some situation, the angle can be 10 degrees, this wastes the user's time and reduces the efficiency of work. Besides, the recess 912 includes the closed top and the closed bottom, so that only T-shaped blade can be used to make the cavity when manufacturing the head of the wrench. The T-shaped blade is an expensive tool and the size of shank of the T-shaped blade is restricted by the inner periphery of the head so that the shank is easily broken. Furthermore, the lip extends from the inner periphery of the through hole 911 and restricts the operation of the tool to drill the through hole 911. The receiving slot 914 is an inclined slot relative to the pawl 30, so that when drilling the receiving slot 914, the tool has to be carefully controlled to prevent from hitting the inner periphery of the through hole 911. The receiving slot 914 includes three inclined directions relative to the through hole 911 in X, Y and Z directions. This makes the drilling of the receiving slot 914 more difficult.

U.S. Pat. No. 6,382,051 discloses another ratchet wheel whose recess includes a closed top and a closed bottom, so that it has the similar shortcomings.

The present invention intends to provide a ratchet wrench which is easily manufactured so as to eliminate the shortcomings mentioned above.

SUMMARY OF THE INVENTION

The present invention relates to a ratchet wrench and comprises a body, a ratchet wheel, a pawl, a ring, a top clip and a bottom clip. The body includes a through hole which is defined through the top and the bottom of the body. The body includes top recessed area and a bottom recessed area respectively defined in the top and the bottom thereof. A recess is defined in the inner periphery of the through hole and a protrusion extends from one end of the recess. A receiving slot is defined in the protrusion. A resilient member is received in the receiving slot so as to bias the pawl in the recess to be engaged with the ratchet wheel. The ring is engaged with the top recessed area to cover the through hole the recess. The top clip is engaged with the top recessed area and presses the ring, and clips the ratchet wheel. The bottom clip is engaged with the bottom recessed area and clips the ratchet wheel.

The primary object of the present invention is to provide a ratchet wrench wherein the recess, the receiving slot and the through hole all have an open top which allows the manufacturers to easily make the through hole, the receiving slot and the recess.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
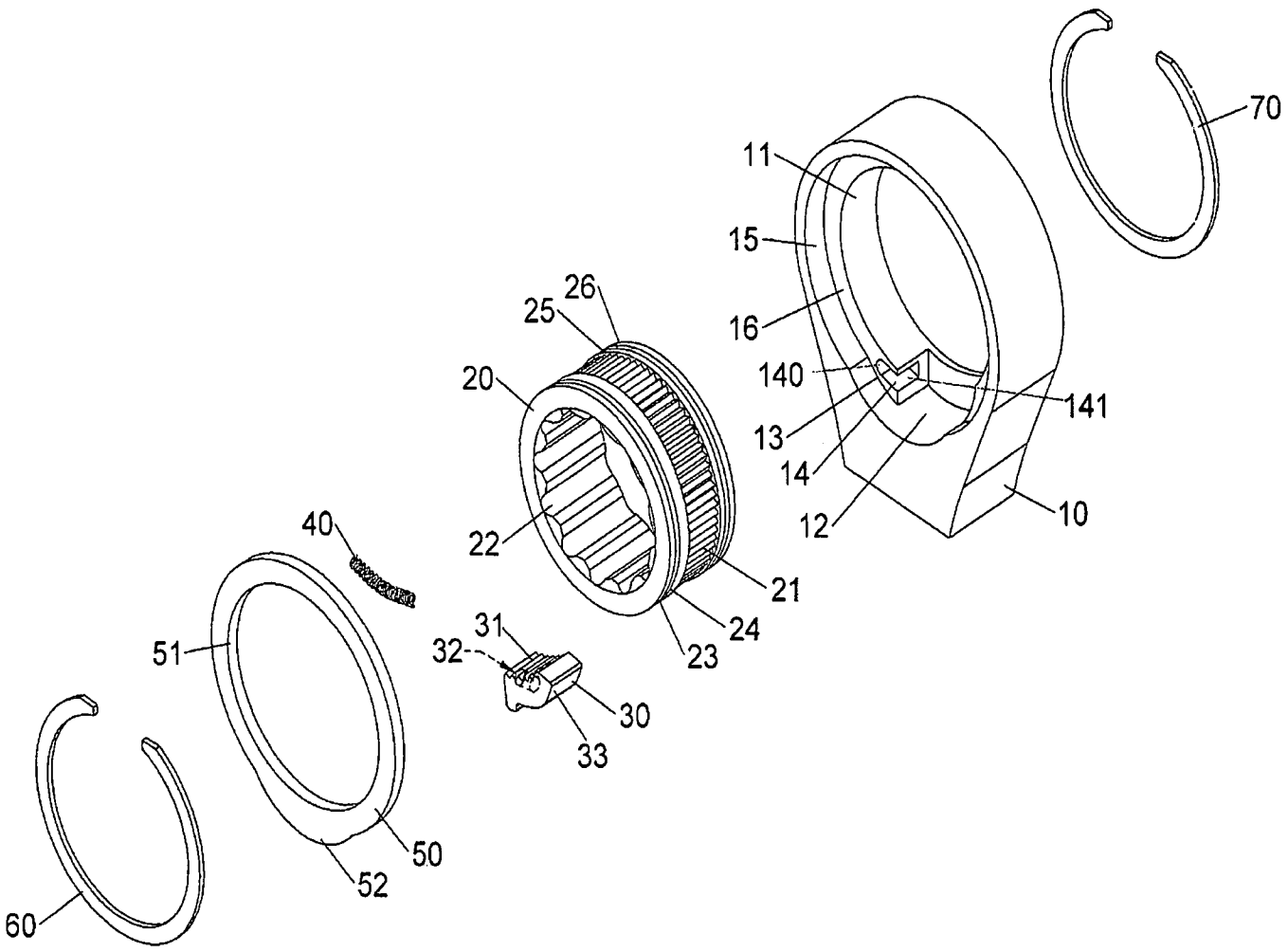
FIG. 1 is an exploded view of the ratchet wrench of the present invention.
Figure 4:
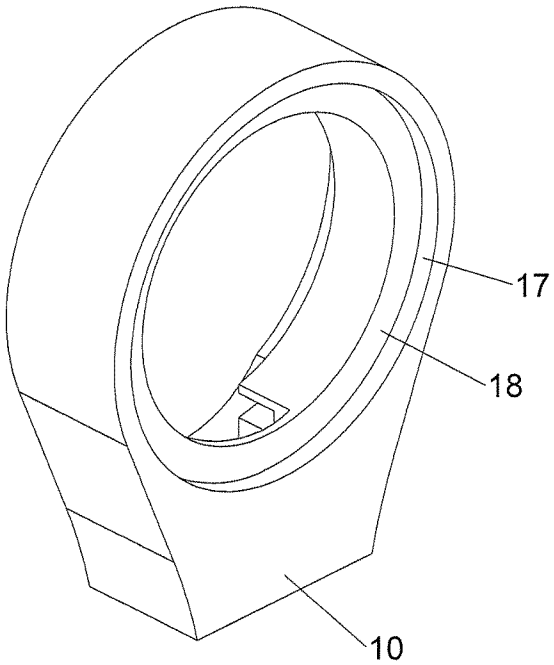
FIG. 4 is another perspective view to show the body of the ratchet wrench of the present invention.
Figure 3:
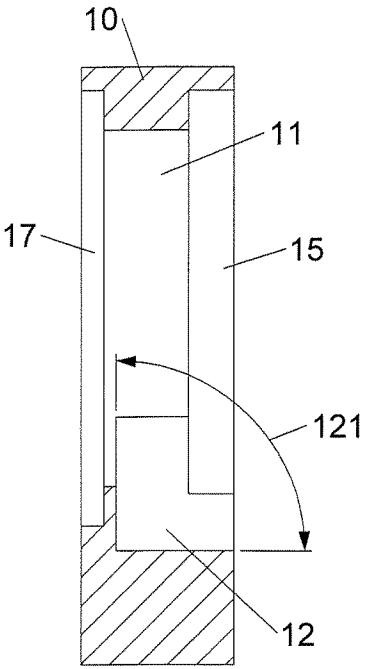
FIG. 3 is a cross sectional view, taken along line 3-3 in FIG. 2.
Figure 2:
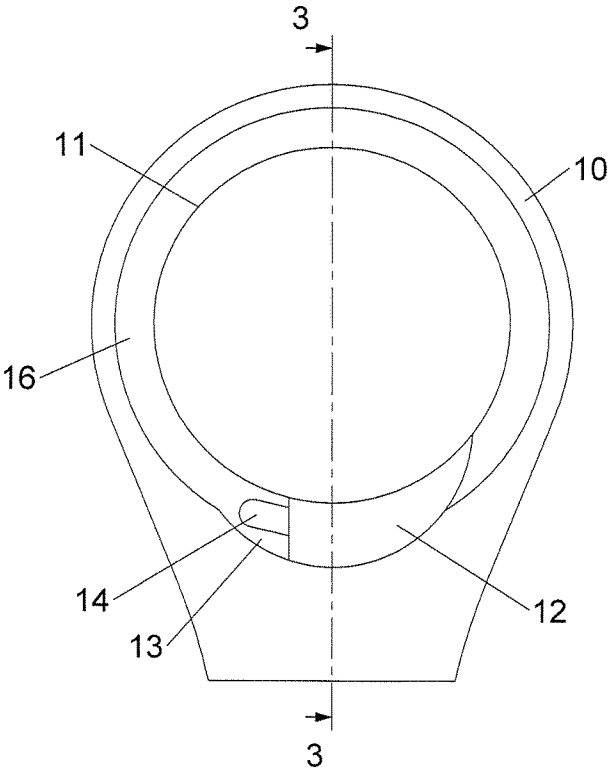
FIG. 2 is a front view of the body of the ratchet wrench of the present invention.
Figure 5:
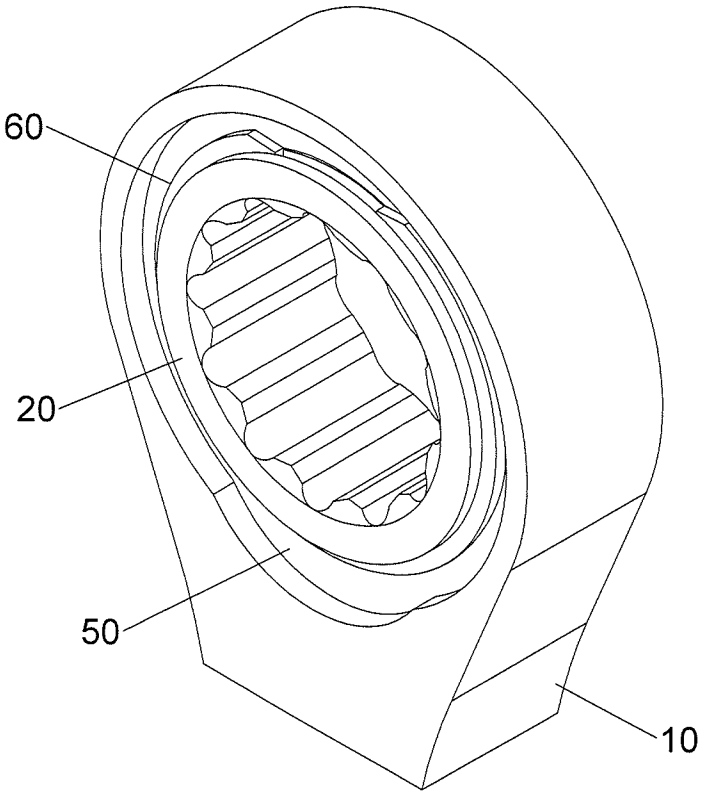
FIG. 5 is a perspective view to show the ratchet wrench of the present invention.
Figure 7:
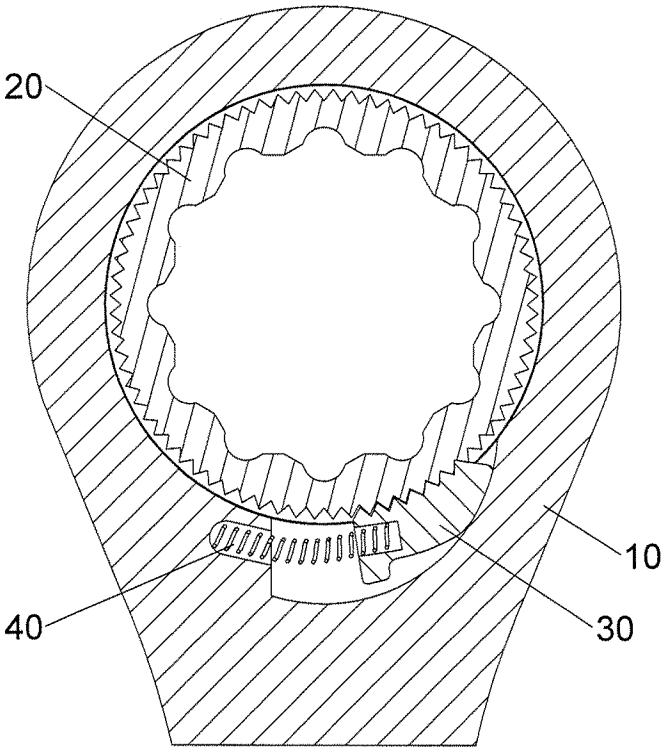
FIG. 7 is a cross sectional view, taken along 7-7 in FIG. 6.
Figure 6:
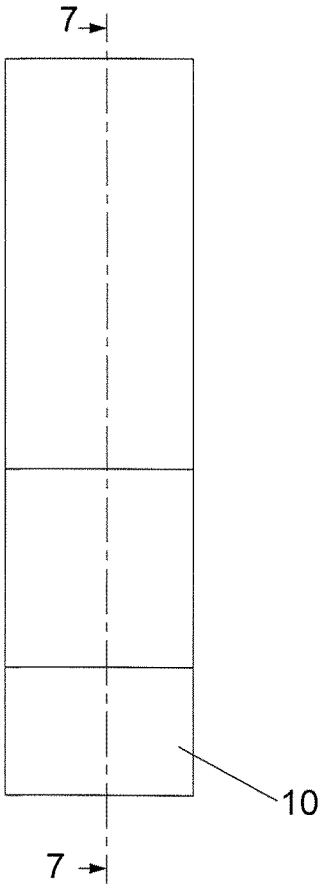
FIG. 6 is a side view of the ratchet wrench of the present invention.
Figure 10:
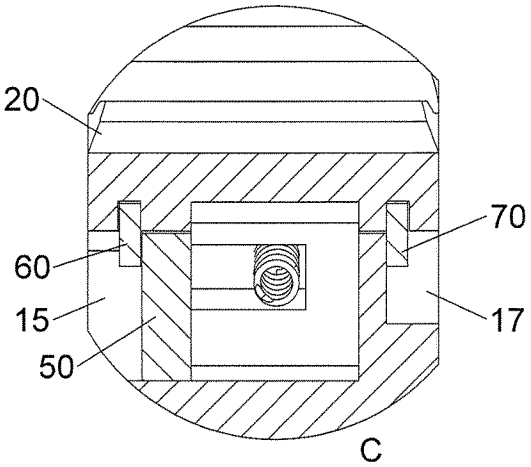
FIG. 10 is an enlarged view of the circled C in FIG. 9.

Referring to FIGS. 1 to 10, the ratchet wrench of the present invention comprises a body 10 having a through hole 11 defined through the top and the bottom thereof. The through hole 11 has a recess 12 defined in the inner periphery thereof, and the center of the recess 12 is located in the through hole 11. The recess 12 is opened through the top of the body 10, and has a closed bottom. A protrusion 13 extends from one end of the recess 12 and has a receiving slot 14 which includes an opening 140 and an entrance 141, wherein the opening 140 is opened through the top of the body 10, the entrance 141 of the receiving slot 14 communicates with and faces the interior of the recess 12. A top recessed area 15 is defined in the top of the body 10, and recessed from the top portion to the top opening of the through hole 11 and shares a common axis with the through hole 11. The top recessed area 15 communicates with the through hole 11, the recess 12 and the receiving slot 14. A first shoulder 16 is formed on the bottom of the top recessed area 15 and positioned between the top recessed area 15 and the through hole 11. The first shoulder 16 is in flush with the top of the protrusion 13. A bottom recessed area 17 is defined in the bottom of the body 10, and recessed from the bottom portion to the bottom opening of the through hole 11 and shares the common axis with the through hole 11. The bottom recessed area 17 is not in communication with the recess 12 and the receiving slot 14. The inner diameter of the bottom recessed area 17 is the same as the inner diameter of the top recessed area 15.

A ratchet wheel 20 is rotatably received in the through hole 11 and includes a ratchet portion 21 defined in the outer periphery thereof. A connection portion 22 is formed to the ratchet wheel 20, wherein the connection portion 22 is a polygonal hole in this embodiment. A first pivotal portion 23 and a second pivotal portion 25 are respectively formed on two ends of the ratchet wheel 20. The first pivotal portion 23 has a top groove 24, and the second pivotal portion 25 has a bottom groove 26. The second pivotal portion 25 is pivotably engaged with the through hole 11 and the bottom recessed area 17.

A pawl 30 is movably received in the recess 12 and has a toothed face 31 defined in the front side thereof, and the toothed face 31 is engaged with the ratchet portion 21 of the ratchet wheel 20. The pawl 30 has a positioning portion 32 defined in the first end thereof, and the positioning portion 32 faces the entrance 141. The pawl 30 has a contact end 33 defined the second end thereof, and the contact end 33 contacts the inner periphery of the recess 12. A first angle 121 is defined between the inner end of the first recess 12 and the inner periphery of the first recess 12. The first angle 121 is between 90 to 120 or 100 degrees. A second angle is defined between the contact end 33 and a rear side of the pawl 30 that faces the inner end of the first recess 12. The second angle is matched with the first angle 121.

A resilient member 40 is received in the recess 12 and biased between the inner end of the receiving slot 14 and the positioning portion 32 to engage the toothed face 31 of the pawl 30 engaged with the ratchet portion 21 of the ratchet wheel 20.

A ring 50 is received in the top recessed area 15 and contacts the first shoulder 16 and the top of the protrusion 13. The ring 50 has an inner periphery 51 thereof mounted to the first pivotal portion 23. The ring 50 further includes a lid 52 extending therefrom, so that the ring 50 is shaped to cover the recess 12 and the top recessed area 15 to cover up the pawl 30 and the resilient member 40.

A top clip 60 is engaged with the top recessed area 15 and the top groove 24, and contacts the ring 50 to restrict the ring 50 from separating from the ratchet wheel 20. A bottom clip 70 is engaged with the bottom recessed area 17 and the bottom groove 26, and contacts the second shoulder 18 formed on the bottom of the bottom recessed area 17 and positioned between the bottom recessed area 17 and the through hole 11. The ratchet wheel 20 is restricted within the through hole 11 by the ring 50, the top clip 60 and the bottom clip 70.

Figure 13:
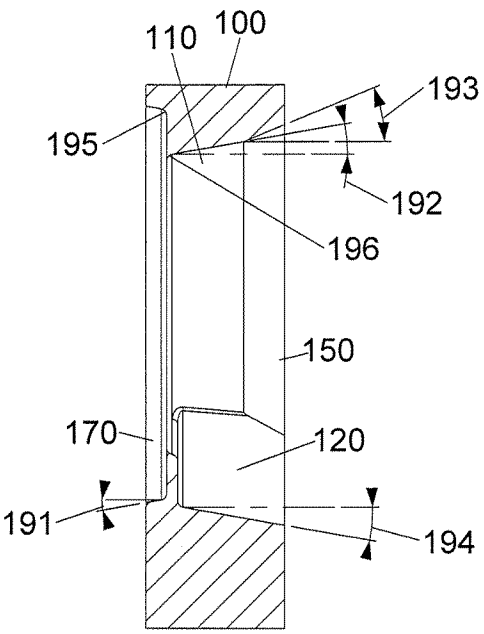
FIG. 13 is a cross sectional view, taken along 13-13 in FIG. 12.
Figure 12:
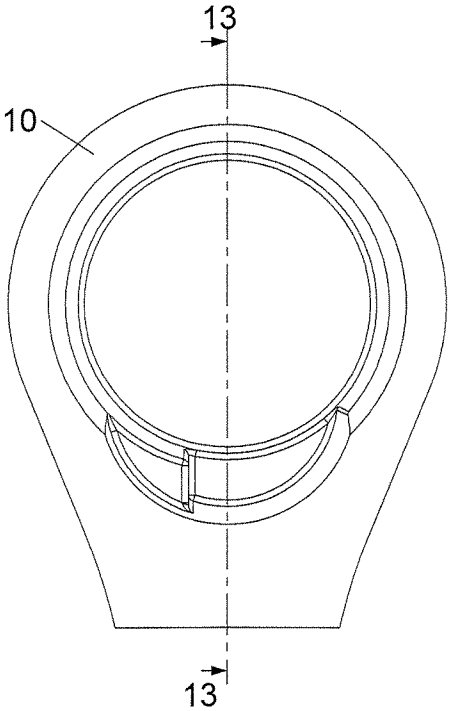
FIG. 12 shows the front view of the body after being forged in the rough forging mold set.
Figure 11:
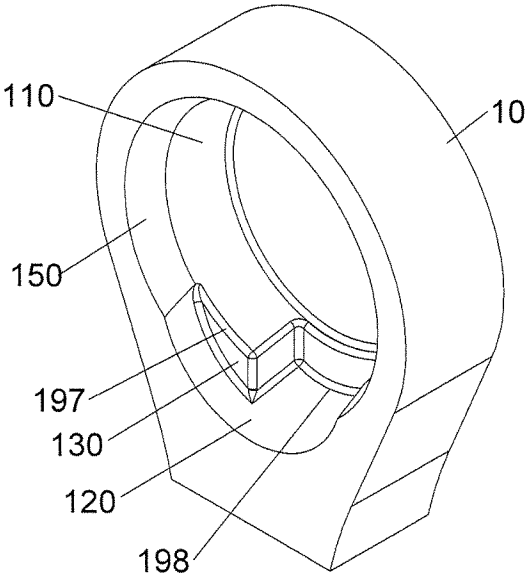
FIG. 11 shows the body after being forged in the rough forging mold set.

As shown in FIGS. 11 to 13, the method for making the body 10 includes to put a cylindrical body in a rough forging mold set to be treated so that the cylindrical body is forged into a first-stage body 100 which includes a first through hole 110, a first recess 120, a first protrusion 130, a first top recessed area 150 and a first bottom recessed area 170 in the rough forging mold set. An angle 192 of 8 to 12 degrees is defined between the inner periphery of the first through hole 110 and an axis "A" passing through the top and bottom of the first-stage body 100. An angle 194 of 8 to 12 degrees is defined between the inner periphery of the first recess 120 and the axis "A" of the first-stage body 100. An angle 191 of 8 to 12 degrees is defined between the inner periphery of the first bottom recessed area 170 and the axis "A" of the first-stage body 100. An angle 193 of 20 to 24 degrees is defined between the inner periphery of the first top recessed area 150 and the axis "A" of the first-stage body 100.

A first curved angle 195 is defined between the first bottom recessed area 170 and the second shoulder 18. A second curved angle 196 is defined between the first through hole 110 and the first bottom recessed area 170. The first protrusion 130 has a third curved angle 197 formed along edges thereof. A fourth curved angle 198 is formed at the lower edge of the first recess 120.

Figure 16:
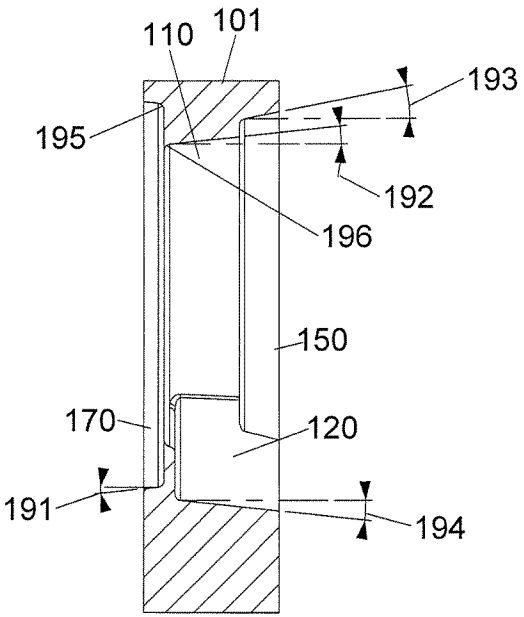
FIG. 16 is a cross sectional view, taken along 16-16 in FIG. 15.
Figure 15:
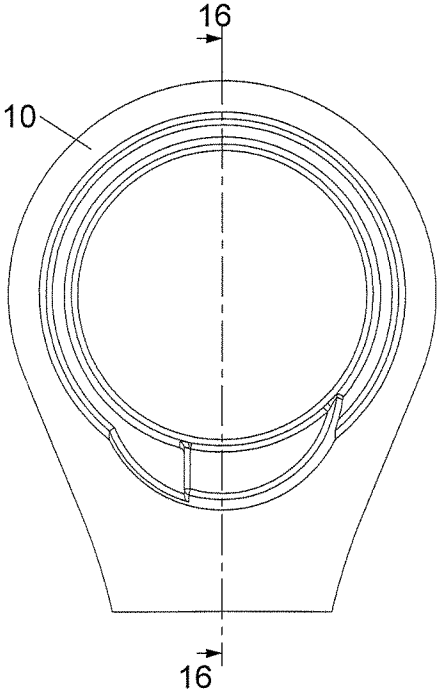
FIG. 15 shows the front view of the body after being forged in the fine forging mold set.
Figure 14:
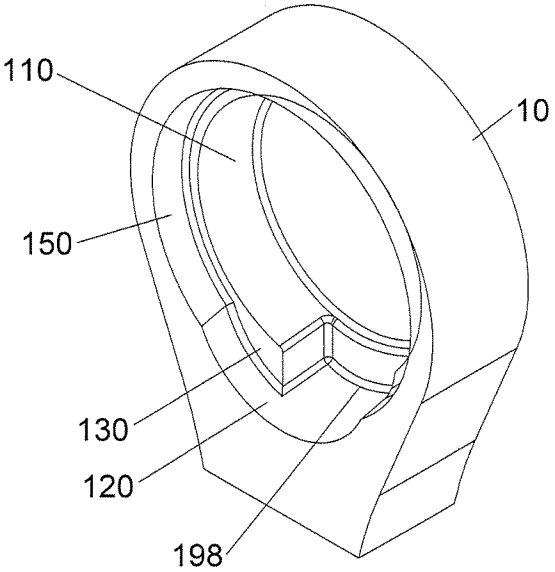
FIG. 14 shows the body after being forged in the fine forging mold set.
Figure 17:
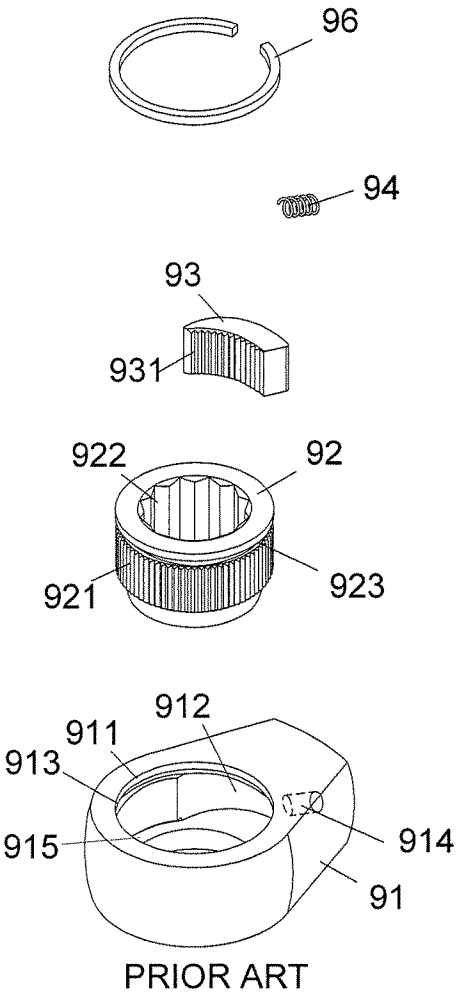
PRIOR ART FIG.17
FIG. 17 is an exploded view of the conventional ratchet wrench.
Figure 19:
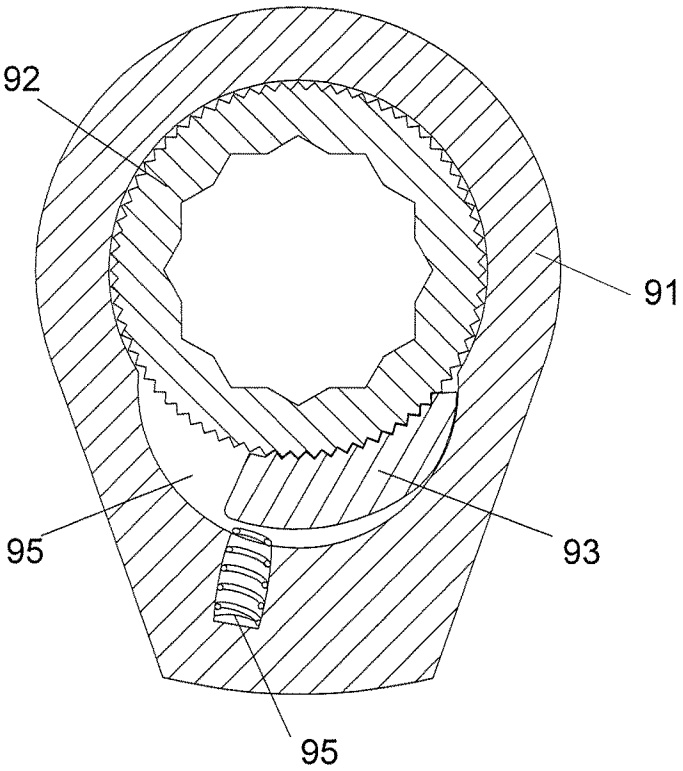
PRIOR ART FIG.19
FIG. 19 is a cross sectional view, taken along line 19-19 in FIG. 18.
Figure 18:
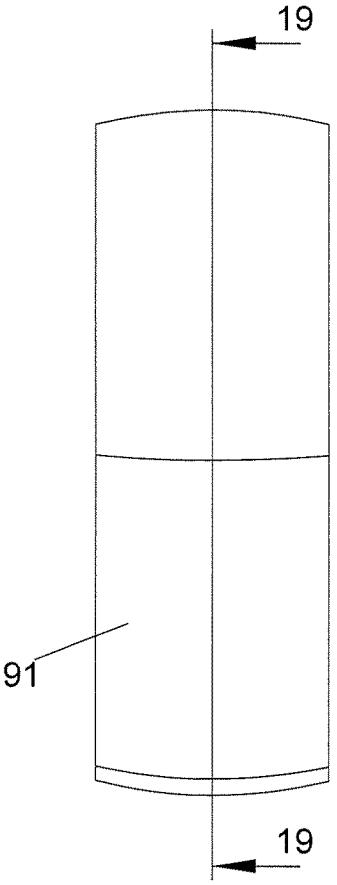
PRIOR ART FIG.18
FIG. 18 is a side view of the conventional ratchet wrench.

As shown in FIGS. 14 to 16, the first-stage body 100 is then removed from the rough forging mold set and put in a fine forging mold set to be treated to form a second-stage body 101 which is shaped more close to the body 10 as disclosed in FIG. 1. The first-stage body 100 is forged and formed in the fine forging mold set to become the second-stage body 101 which form the first through hole 110, the first recess 120, the first protrusion 130, the first top recessed area 150 and the first bottom recessed area 170 in detailed specifications. The three angles 191, 192 and 194 are changed to 4 to 6 degrees after being forged in the fine forging mold set. The angle 193 is changed to 10 to 12 degrees after being forged in the fine forging mold set. The third curved angle 197 is removed after being forged in the fine forging mold set.

The second-stage body 101 removed from the fine forging mold set is then put in a final mold set and treated by a punching machine to remove the four angles 191, 192, 193, 194, and to remove the first, second and fourth curved angles 195, 196, 198 to complete the formation of the through hole 11, the recess 12, the protrusion 13, the receiving slot 14, the top recessed area 15 and the bottom recessed area 17. The final product is the body 10 as disclosed in FIG. 1. The receiving slot 14 is punched in the protrusion 13.

The method for making the ratchet wrench includes the following steps:

step 1: preparing material according to the design of the body 10;

step 2: forging the material for the body 10 in a rough forging mold, and the material is formed to have the through hole 11, the recess 12, the protrusion 13 and the bottom recessed area 17;

step 3: the body 10 removed from the rough forging mold set and put in a fine forging mold set to be treated to form the through hole 11, the recess 12, the protrusion 13 and the bottom recessed area 17 in detailed specifications;

step 4: the body 10 removed from the fine forging mold set and the edges are cut under certain temperature;

step 5: the body 10 put in a final mold set and treated by a punching machine to make the through hole 11 through the body 10, so that the through hole 11, the recess 12, the protrusion 13, the receiving slot 14, the top recessed area 15 and the bottom recessed area 17 are completely formed as shown in FIG. 1;

step 6: the body 10 being treated by the process of annealing, the temperature of the body after going through the process of annealing is 18-25 degrees Celsius;

step 7: the body 10 being treated by the process of sand blasting to remove defects of oxidation from the surface of the body 10;

step 8: the body 10 being polished to reduce the roughness of the surface of the body 10;

step 9: grinding the body 10 to make the thickness of the body 10 meet the tolerance requirement of design;

step 10: the body 10 being treated by heat treatment to change the microstructure of the surface and interior of the body 10;

step 11: the body being treated by vibration grinding to further polish the surface of the body 10;

step 12: the body 10 being electro-coated to increase the features of anti-corrosion and durability, and to have an aesthetic outer appearance; and step 13: the ratchet wheel 20, the pawl 30, the resilient member 40, the ring 50, the top clip 60 and the bottom clip 70 being installed to the body 10.

In another embodiment, the connection portion 22 can be a rectangular protrusion.

The advantages of the present invention are that the recess 12 and the receiving slot 14 are opened to the top of the body 10 so that they are easily manufactured.

The through hole 11 is defined through the body 10 so that the feeding of the tool making the through hole 11 does not need to be carefully controlled.

The through hole 11, the recess 12 and the receiving slot 14 are able to be made by the same one drilling tool.

The through hole 11, the recess 12 and the receiving slot 14 are able to be completed in the same machine.

The through hole 11, the recess 12 and the receiving slot 14 are opened to the top of the body 10, so that they can be done by one time of punching after being forged.

The body 10 can be manufactured by either drilling or punching, the options are plenty.

The receiving slot 14 needs not to be made by any extra process so as to save manufacturing cost.

Figure 9:
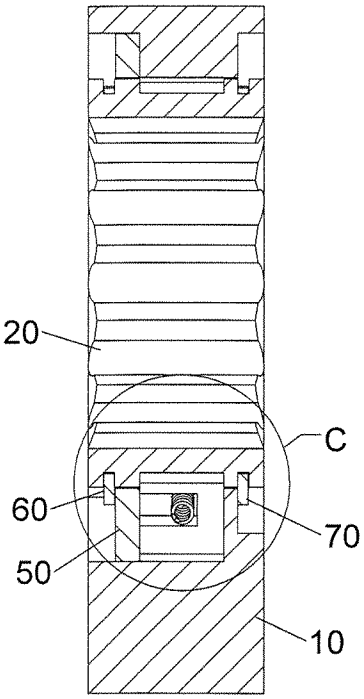
FIG. 9 is a cross sectional view, taken along 9-9 in FIG. 8.
Figure 8:
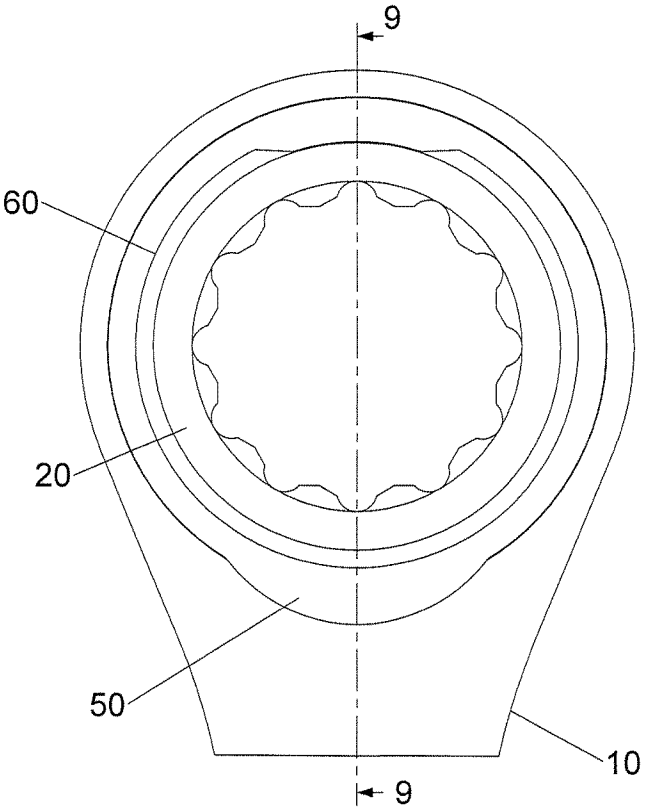
FIG. 8 is a front view of the ratchet wrench of the present invention.

As shown in FIG. 9, the ratchet wheel 20 is positioned in the through hole 11 by the ring, the top and bottom clips 60, 70, so that the ratchet wheel 20 is easily removed from the body 10.

The first pivotal portion 23 and the second pivotal portion 25 are respectively connected to the inner periphery of the ring 50 and the through hole 11 so that the ratchet wheel 20 is stably installed.

When removing either one of the top clip 60 or the bottom clip 70, the ratchet wheel 20 is conveniently removed from the through hole 11 to replace parts in the body 10.

While we have shown and described the embodiment in accordance with the present invention, it should be clear to those skilled in the art that further embodiments may be made without departing from the scope of the present invention.

What is claimed is:

1. A ratchet wrench comprising:

a body (10) having a through hole (11) defined through a top and a bottom of the body (10), the through hole (11) having a recess (12) defined in an inner periphery of the through hole (11), a center of the recess (12) located in the through hole (11), the recess (12) being opened through the top of the body (10), and having a closed bottom, wherein a protrusion (13) extending from one end of the recess (12) and having a receiving slot (14) which includes an opening (140) and an entrance (141), the opening (140) being opened through the top of the body (10); the entrance (141) of the receiving slot (14) communicating with and facing an interior of the recess (12); a top recessed area (15) defined in the top of the body (10), and recessed from a top portion of the top of the body (10) to a top opening of the through hole (11) and sharing a common axis with the through hole (11); the top recessed area (15) communicating with the recess (12); a first shoulder (16) formed on a bottom of the top recessed area (15) and positioned between the top recessed area (15) and the through hole (11), the first shoulder (16) being flush with a top of the protrusion (13); a bottom recessed area (17) defined in the bottom of the body (10), and recessed from a bottom portion of the bottom of the body (10) to a bottom opening of the through hole (11) and sharing the common axis with the through hole (11); a second shoulder (18) formed on a bottom of the bottom recessed area (17);

a ratchet wheel (20) rotatably received in the through hole (11) and having a toothed portion (21) defined in an outer periphery of the ratchet wheel (20), a connection portion (22) formed in the ratchet wheel (20), a first pivotal portion (23) and a second pivotal portion (25) respectively formed on two ends of the ratchet wheel (20), the first pivotal portion (23) having a top groove (24), the second pivotal portion (25) having a bottom groove (26), the second pivotal portion (25) pivotably engaged with the through hole (11) and the bottom recessed area (17);

a pawl (30) movably received in the recess (12) and having a toothed face (31) defined in a front side of the pawl (30), the toothed face (31) engaged with the toothed portion (21) of the ratchet wheel (20), the pawl (30) having a positioning portion (32) defined in a first end of the pawl (30), the positioning portion (32) facing the entrance (141) and being a slot or a rod configured to connect a resilient member (40), the pawl (30) having a contact end (33) defined at a second end of the pawl (30), the contact end (33) contacting an inner periphery of the recess (12);

the resilient member (40) received in the recess (12) and biased between an inner end of the receiving slot (14) and the positioning portion (32) so as to engage the toothed face (31) of the pawl (30) with the toothed portion (21) of the ratchet wheel (20);

a ring (50) received in the top recessed area (15) and contacting the first shoulder (16) and the top of the protrusion (13), the ring (50) having an inner periphery (51) of the ring (50) mounted to the first pivotal portion (23), the ring (50) being shaped to cover the recess (12) and the top recessed area so as to cover up the pawl (30) and the resilient member (40);

a top clip (60) engaged with the top recessed area (15) and the top groove (24) and contacting the ring (50) to restrict the ring (50) from separating from the ratchet wheel (20), and a bottom clip (70) engaged with the bottom recessed area (17) and the bottom groove (26) and contacting the second shoulder (18), the ratchet wheel (20) being restricted within the through hole (11) by the ring (50), the top clip (60) and the bottom clip (70).

2. The ratchet wrench as claimed in claim 1, wherein a first angle (121) is defined between an inner end of the recess (12) and the inner periphery of the recess (12), the first angle (121) is from 90 to 120 degrees, a second angle is defined between the contact end (33) and a rear side of the pawl (30) that faces the inner end of the recess (12), the second angle is matched with the first angle (121).

3. The ratchet wrench as claimed in claim 1, wherein the connection portion (22) is a polygonal hole or a rectangular protrusion.

4. The ratchet wrench as claimed in claim 1, wherein the top clip (60) and the bottom clip (70) each are a resilient C-clip.

5. The ratchet wrench as claimed in claim 1, wherein an inner diameter of the bottom recessed area (17) is the same as an inner diameter of the top recessed area (15).

6. A ratchet wrench comprising:

a body (10) having a through hole (11) defined through a top and a bottom of the body (10), the through hole (11) having a recess (12) defined in an inner periphery of the through hole (11), a center of the recess (12) located in the through hole (11), the recess (12) being opened through the top of the body (10), and having a closed bottom, wherein a protrusion (13) extending from one end of the recess (12) and having a receiving slot (14) which includes an opening (140) and an entrance (141), the opening (140) being opened through the top of the body (10), the entrance (141) of the receiving slot (14) communicating with and facing an interior of the recess (12); a top recessed area (15) defined in the top of the body (10), and recessed from a top portion of the top of the body (10) to a top opening of the through hole (11) and sharing a common axis with the through hole (11); the top recessed area (15) communicating with the recess (12); a first shoulder (16) formed on a bottom of the top recessed area (15) and positioned between the top recessed area (15) and the through hole (11), the first shoulder (16) being flush with a top of the protrusion (13); a bottom recessed area (17) defined in the bottom of the body (10), and recessed from a bottom portion of the bottom of the body (10) to a bottom opening of the through hole (11) and sharing the common axis with the through hole (11); a second shoulder (18) formed on a bottom of the bottom recessed area (17);

a ratchet wheel (20) rotatably received in the through hole (11) and having a toothed portion (21) defined in an outer periphery of the ratchet wheel (20), a connection portion (22) formed in the ratchet wheel (20), a first pivotal portion (23) and a second pivotal portion (25) respectively formed on two ends of the ratchet wheel (20), the first pivotal portion (23) having a top groove (24), the second pivotal portion (25) having a bottom groove (26), the second pivotal portion (25) pivotably engaged with the through hole (11) and the bottom recessed area (17);

a pawl (30) movably received in the recess (12) and having a toothed face (31) defined in a front side of the pawl (30), the toothed face (31) engaged with the toothed portion (21) of the ratchet wheel (20), the pawl (30) having a positioning portion (32) defined in a first end of the pawl (30), the positioning portion (32) facing the entrance (141) and being a slot configured to connect a resilient member (40), the pawl (30) having a contact end (33) defined at a second end of the pawl (30), the contact end (33) contacting an inner periphery of the recess (12);

the resilient member (40) received in the recess (12) and biased between an inner end of the receiving slot (14) and the positioning portion (32) so as to engage the toothed face (31) of the pawl (30) with the toothed portion (21) of the ratchet wheel (20);

a ring (50) received in the top recessed area (15) and contacting the first shoulder (16) and the top of the protrusion (13), the ring (50) having an inner periphery (51) of the ring (50) mounted to the first pivotal portion (23), the ring (50) being shaped to cover the recess (12) and the top recessed area so as to cover up the pawl (30) and the resilient member (40);

a top clip (60) engaged with the top recessed area (15) and the top groove (24) and contacting the ring (50) to restrict the ring (50) from separating from the ratchet wheel (20), and a bottom clip (70) engaged with the bottom recessed area (17) and the bottom groove (26) and contacting the second shoulder (18), the ratchet wheel (20) being restricted within the through hole (11) by the ring (50), the top clip (60) and the bottom clip (70).

7. The ratchet wrench as claimed in claim 6, wherein a first angle (121) is defined between an inner end of the recess (12) and the inner periphery of the recess (12), the first angle (121) is from 90 to 120 degrees, a second angle is defined between the contact end (33) and a rear side of the pawl (30) that faces the inner end of the recess (12), the second angle is matched with the first angle (121).

8. The ratchet wrench as claimed in claim 6, wherein the connection portion (22) is a polygonal hole or a rectangular protrusion.

9. The ratchet wrench as claimed in claim 6, wherein the top clip (60) and the bottom clip (70) each are a resilient C-clip.

10. The ratchet wrench as claimed in claim 6, wherein an inner diameter of the bottom recessed area (17) is the same as an inner diameter of the top recessed area (15).

* * * * *